US010618785B2

(12) United States Patent
Kösterke et al.

(10) Patent No.: US 10,618,785 B2
(45) Date of Patent: Apr. 14, 2020

(54) MOBILE SHAFT WINCH

(71) Applicant: OLKO-MASCHINENTECHNIK GMBH, Olfen (DE)

(72) Inventors: Uwe Kösterke, Bochum (DE); Markus West, Lünen (DE)

(73) Assignee: OLKO-MASCHINENTECHNIK GMBH, Olfen (DE)

( * ) Notice: Subject to any disclaimer, the term of this patent is extended or adjusted under 35 U.S.C. 154(b) by 0 days.

(21) Appl. No.: 15/755,305

(22) PCT Filed: Sep. 13, 2016

(86) PCT No.: PCT/EP2016/071481

§ 371 (c)(1),
(2) Date: Feb. 26, 2018

(87) PCT Pub. No.: WO2017/055069

PCT Pub. Date: Apr. 6, 2017

(65) Prior Publication Data

US 2018/0244508 A1 Aug. 30, 2018

(30) Foreign Application Priority Data

Sep. 29, 2015 (DE) ..... 10 2015 116 505

(51) Int. Cl.
*B66D 1/12* (2006.01)
*B66D 1/46* (2006.01)
(Continued)

(52) U.S. Cl.
CPC ..... *B66D 1/46* (2013.01); *B66C 13/22* (2013.01); *B66C 23/40* (2013.01); *B66C 23/54* (2013.01);
(Continued)

(58) Field of Classification Search
CPC ..... B66C 13/22; B66C 23/40; B66C 23/54; B66C 23/80; B66C 2700/0357; B66C 2700/0378
See application file for complete search history.

(56) References Cited

U.S. PATENT DOCUMENTS 1,771,333 A 7/1930 Joret
2,545,795 A * 3/1951 Roos ..... B60K 25/00 254/328
(Continued)

FOREIGN PATENT DOCUMENTS

CN 202465124 U 10/2012
DE 20010030 11/2000
(Continued)

OTHER PUBLICATIONS http://www.siemag-tecberg.de/cms/upload/downloads/de/TI_18_Mobile-Schachtwinde_de.pdf dated Sep. 15, 2015.
(Continued)

*Primary Examiner* — Emmanuel M Marcelo
(74) *Attorney, Agent, or Firm* — Lucas & Mercanti, LLP

(57) ABSTRACT

A mobile shaft winch includes a carrier vehicle with a vehicle drive, which has an internal combustion engine, a rigid base frame and a rotary platform which is arranged on the base frame via a rotary connection. A drum winch is arranged on the rotary platform with a rope drum which is driven by a winch drive and designed for the winding on and unwinding of a haulage rope. The winch drive includes only an electric motor. A control system is designed for a selective operation of the electric motor on a mains supply system or on an electric generator. The internal combustion engine of the vehicle drive, drives the generator, and the generator and the internal combustion engine are arranged on the carrier vehicle.

9 Claims, 3 Drawing Sheets

(51) Int. Cl.

| | |
|---|---|
| ***B66C 23/40*** | (2006.01) |
| ***B66D 1/14*** | (2006.01) |
| ***B66C 13/22*** | (2006.01) |
| ***B66C 23/00*** | (2006.01) |
| ***B66C 23/80*** | (2006.01) |
| ***B66D 1/36*** | (2006.01) |

(52) U.S. Cl.
CPC ..... *B66C 23/80* (2013.01); *B66D 1/12* (2013.01); *B66D 1/14* (2013.01); *B66D 1/36* (2013.01); *B66C 2700/0371* (2013.01); *B66C 2700/0378* (2013.01)

(56) References Cited

U.S. PATENT DOCUMENTS

| | | | | | |
|---|---|---|---|---|---|
| 4,678,143 | A * | 7/1987 | Griffin | B64F 1/06 | 244/63 |
| 5,006,033 | A * | 4/1991 | McConnell | B60P 1/6454 | 298/14 |
| 5,346,018 | A * | 9/1994 | Koster | A01B 59/00 | 172/125 |
| 7,391,129 | B2 * | 6/2008 | Chiao | B60K 6/46 | 307/9.1 |
| 2008/0215700 | A1 * | 9/2008 | Pillar | A62C 27/00 | 709/212 |
| 2009/0095549 | A1 * | 4/2009 | Dalum | B60K 6/12 | 180/65.265 |
| 2010/0219007 | A1 * | 9/2010 | Dalum | B60L 50/16 | 180/65.22 |
| 2012/0160796 | A1 * | 6/2012 | Weckbecker | B66C 13/28 | 212/284 |
| 2012/0207620 | A1 * | 8/2012 | Dalum | B60K 6/12 | 417/44.1 |
| 2012/0303397 | A1 * | 11/2012 | Prosser | B60L 53/57 | 705/7.12 |
| 2015/0135863 | A1 * | 5/2015 | Dalum | B60K 25/00 | 74/11 |
| 2018/0154773 | A1 * | 6/2018 | Dalum | B60K 17/28 | |

FOREIGN PATENT DOCUMENTS

| | | | |
|---|---|---|---|
| DE | 102010063911 | A1 | 6/2012 |
| DE | 102012201140 | A1 | 8/2013 |
| GB | 2352709 | B | 3/2003 |
| JP | H09278371 | A | 10/1997 |
| WO | 2012115567 | A1 | 8/2012 |

OTHER PUBLICATIONS

Opposition, Sep. 21, 2018.

"Bedienungsanleitung fiir den Autodrehkran ADK 63"—VEB Hebezeugwerk Sebnitz, DDR; Relevant Excerpts.

"Giganten der Arbeit"—Walter Ltitche, ISBN 3-934518-05-2; Relevant Excerpts.

IP Australia, Statement of Grounds and Particulars for the corresponding Australian Patent Application No. 2019330141, dated Jun. 6, 2019 (11 pages).

* cited by examiner

MOBILE SHAFT WINCH

CROSS-REFERENCE TO RELATED APPLICATIONS

This application is a 371 of PCT/EP2016/071481 filed Sep. 13, 2016, which in turn claims the priority of DE 10 2015 116 505.8 filed Sep. 29, 2015, the priority of both applications is hereby claimed and both applications are incorporated herein by reference.

BACKGROUND OF THE INVENTION

The invention relates to a mobile shaft winch comprising a carrier vehicle with a vehicle drive, which has an internal combustion engine, with a rigid base frame and a rotary platform which is arranged on the base frame via a rotary connection, a drum winch, arranged on the rotary platform, with a rope drum which is driven by a winch drive and designed for the winding on and unwinding of a haulage rope, and also a control system for the winch drive.

Mobile shaft winches as inspection installations, auxiliary installations and emergency rescue installations in accordance with mining regulations for shaft and inclined haulage installations are known from the prior art. The firm of SIEMAG TECBERG promotes in the brochure "SIEMAG TECBERG, mobile shaft winch", downloaded under the Internet domain http://www.siemag-tecberg.de/cms/upload/downloads/de//TI_18_Mobile-Schachtwinde_de.pdf on Sep. 15, 2015, a mobile shaft winch which is designed as an autonomous inspection installation for the inspection of haulage shafts and as an emergency installation for the rescue of people. The drum winch is mounted on a modified, four-axle automotive truck. The automotive truck is equipped with a diesel engine as the drive engine. A rotary platform is connected via a ball bearing-mounted slewing ring to the base frame of the automotive truck. Fastened on the rotary platform are a control cabin with a switchboard, a jib, a drum for the haulage rope and auxiliary drives for the jib and winch movement. Fastened on the haulage rope end is a cage for the rescue of people or for the transporting of smaller pieces of equipment. As a small man-haulage installation, the conveyance of ten people at most is permissible.

The drive concept of the known mobile shaft winch of SIEMAG TECBERG is explained in more detail below with reference to FIG. 3:

The drive (1) of the winch (2) is formed by a hydraulic motor (1*a*) and a transmission (1*b*). The driving of the hydraulic motor (1*a*) is carried out by hydraulic fluid from a tank (3), which is delivered by means of one of the two pumps (4, 5). The first pump (4) is driven by a diesel engine which is arranged on the mobile shaft winch. The second pump (5) is driven by an electric motor which is arranged on the mobile shaft winch. The selective operation of the hydraulic motor (1*a*) via the first pump (4) or the second pump (5) is carried out via a hydraulic control system (6). During standard operation, the driving of the hydraulic motor (1*a*) is carried out by the hydraulic pump (5) which is driven by the electric motor (5*a*), wherein the electric motor (5*a*) is supplied with power from the mains supply system (7). In the event of power failure, or if for other reasons no mains supply system (7) is available, a switch is made to the pump (4) which is driven by the diesel engine (4*a*).

The hydraulic pumps (4, 5) also drive the hydraulic actuators for the auxiliary functions of the mobile shaft winch, such as the drive components of the jib and of the rotary drive for the rotary platform.

The known mobile shaft winch has considerable weight which is caused by the two hydraulic pumps (4, 5) and also the necessary diesel engine and electric motor. The installation space requirement leads, moreover, to confined space conditions on the automotive truck chassis of the mobile shaft winch.

BRIEF SUMMARY OF THE INVENTION

An object of the present invention is to provide a mobile shaft winch which requires a smaller installation space, has less weight and a simpler construction than the prior art and to provide an improved control system of the drum winch.

The object is met in that the winch drive is carried out purely electrically. In detail, the object is achieved by a mobile shaft winch with

- a carrier vehicle,
- a winch drive driven solely by an electric motor,
- a control system designed for a selective operation of the electric motor on a mains supply system or on an electric generator, and
- an internal combustion engine that drives the generator,
- wherein the generator and the internal combustion engine are arranged on the carrier vehicle.

The power for operating the electric motor is provided without additional hydraulic units via the mains supply system and in the event of its failure or non-availability via a generator which is driven by an internal combustion engine, especially a diesel engine. A further reduction of the weight and installation space is achieved by the fact that the internal combustion engine of the vehicle drive drives the generator via a power take-off. The drive engine which is not required for driving the carrier vehicle during operation of the drum winch therefore undertakes a double function so that the mobile shaft winch according to the invention can be produced in a considerably simpler and therefore more cost-effective manner. The power take-off is preferably constructed as an engageable shaft on an auxiliary output of the transmission of the vehicle drive which feeds the necessary kinetic energy to the electric generator. In principle, however, the generator can also be driven by an additional internal combustion engine, especially a diesel engine, which is separate from the vehicle drive.

A hydraulic system, which is arranged on the rotary platform of the carrier vehicle and designed for an operation of auxiliary functions of the mobile shaft winch, can be of a considerably smaller, simpler and lighter construction than the hydraulic system in the prior art which also has to ensure the driving of the drum winch. A hydraulic system for the operation of auxiliary functions for the mobile shaft winch comprises

- a tank for holding hydraulic fluid,
- an electrically driven hydraulic pump with a suction side and a pressure side, wherein the suction side is in fluid-conducting communication with the tank and the pressure side is in fluid-conducting communication with at least one actuator for the operation of an auxiliary function.

As actuators, the hydraulic system has especially hydraulic cylinders and/or hydraulic motors. If the mobile shaft winch has a telescopic jib, the angle thereof in relation to the rotary platform is altered preferably by a hydraulic cylinder. The relative rotation of the rotary platform to the base frame is carried out for example by a hydraulic motor. The electrically driven hydraulic pump for operating the actuators for the auxiliary functions is designed for a selective operation on the mains supply system or, if this is not available, on the electric generator which when required also provides the power for the electric motor of the winch drive.

According to an embodiment of the invention, arranged on the rotary platform of the mobile shaft winch is a telescopic jib with guide elements, especially guide rollers, for the haulage rope, with the aid of which the cage which is fastened on the haulage rope end is oriented in the vertical extension of the shaft. Alternatively or additionally, the haulage rope can be deflected into the shaft via guide elements, especially via a cable sheave which is arranged on a haulage frame.

A shielded cable can be embedded in the core of the haulage rope via which a signal transmission can be transmitted between people in the cage and a counterpart station of the mobile shaft winch.

In order to improve the upright position of the carrier vehicle during operation of the mobile shaft winch, this is preferably equipped with extendable hydraulic supports.

BRIEF DESCRIPTION OF THE DRAWINGS

The invention is explained in more detail below with reference to the drawings. In the drawings

DETAILED DESCRIPTION OF THE PRESENT INVENTION

Figure 1:
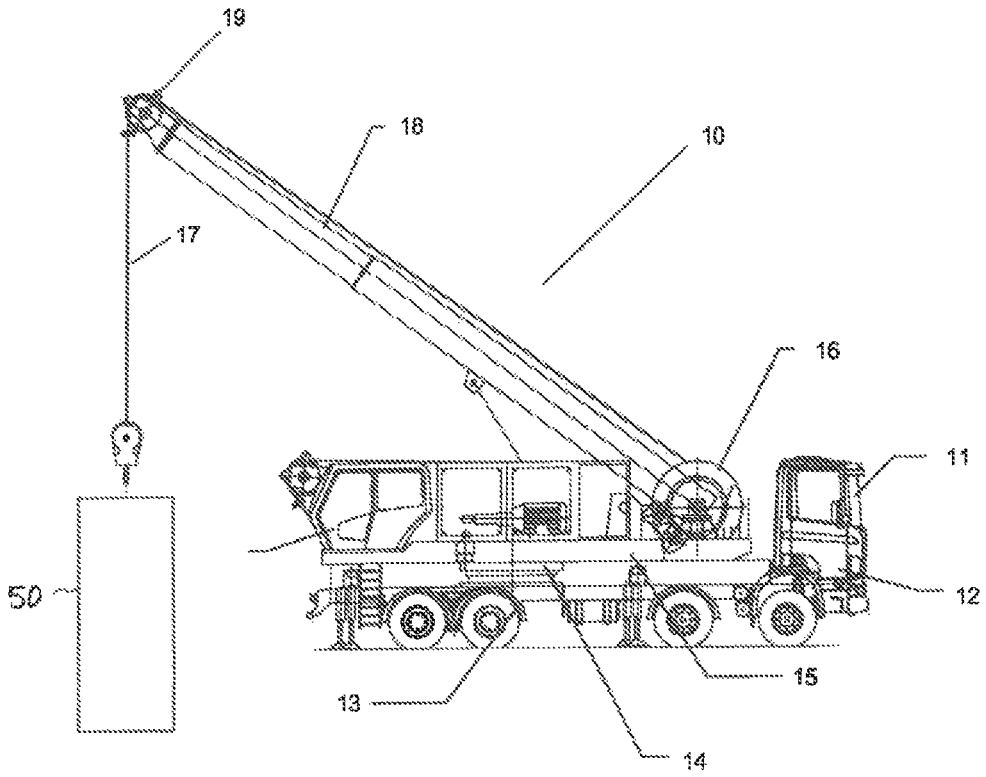
FIG. 1 shows a schematic overall view of a mobile shaft winch according to the invention.

FIG. 1 shows a mobile shaft winch with an automotive truck as the carrier vehicle (11) with a vehicle drive (12) which is formed by a diesel engine with a flanged-on transmission. A rotary platform (15) is arranged on a rigid base frame (13) of the automotive truck via a rotary connection (14).

Located on the rotary platform (15) is a drum winch (16), which is driven by a winch drive, for the winding on and unwinding of a haulage rope (17). A telescopic jib (18) extends from the drum winch (16), with the aid of which the haulage rope (17), with a cage (50) attached to its rope end, is oriented over the shaft opening (the cage (50) is shown schematically in FIG. 1 and is not meant to depict a shape, a size, or any other, characteristic of, the cage (50)). Rotatably mounted on the end of the telescopic jib (18) is a deflection roller (19) for deflecting the haulage rope (17).

Figure 2:
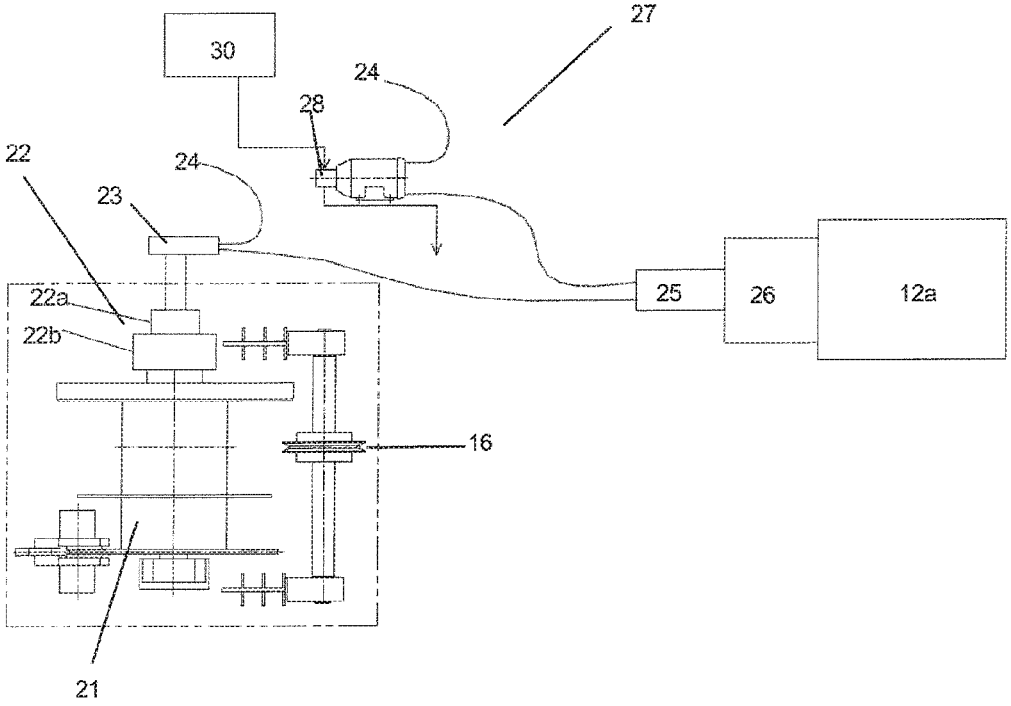
FIG. 2 shows a basic view for illustrating the drive concept of the mobile shaft winch and FIG. 3 shows a basic view for illustrating the drive concept of a mobile shaft winch according to the prior art.
Figure 3:
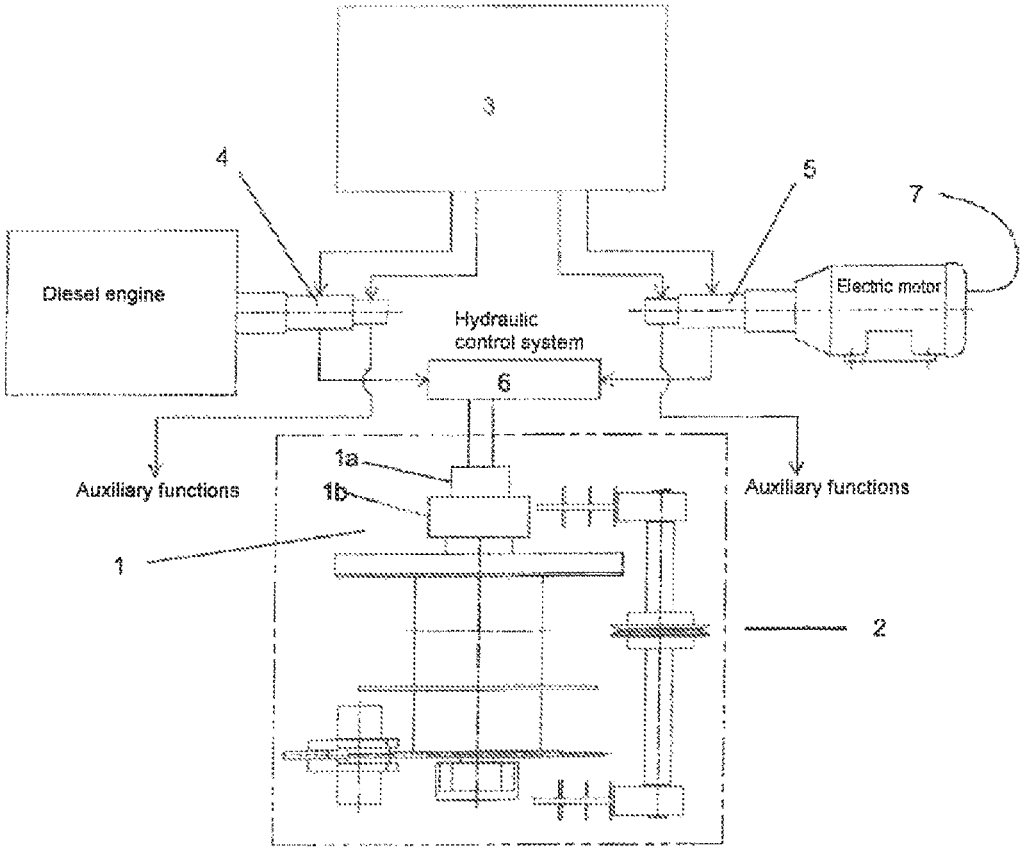
Fig. 3 PRIOR ART

Also located on the rotary platform (15) are the drive components of the drum winch (16) and also for the auxiliary functions which are explained in more detail below with reference to FIG. 2.

The drum winch (16) comprises a rope drum (21) which is connected to a winch drive (22) which is formed by an electric motor (22*a*) and a transmission (22*b*) which steps down the rotational speed of the electric motor (22*a*). Via a control system (23), the electric motor (22*a*) can be selectively operated on a mains supply system (24) or on an electric generator (25). During standard operation, the electric motor (22*a*) is operated on the mains supply system (24). If the mains supply system (24) is not available, the generator (25) undertakes the power supply of the electric motor (22*a*).

The electric motor (22*a*) of the winch drive (22) is preferably a servo motor. As a result of this, a precise controlling of the angular position of the motor shaft and also of the rotational speed and acceleration is possible. The use of a servo motor for the winch drive (22) enables a considerably more accurate controlling of the drum winch and therefore positioning of the cage which is fastened on the haulage rope end.

The generator (25) is driven via a power take-off (26) of the diesel engine (12*a*) of the automotive truck, optimally utilizing the space conditions of the mobile shaft winch (10) and also of the vehicle drive (12) which is available anyway.

In the case of the power take-off (26), it is an engageable drive shaft on an auxiliary output of the transmission of the vehicle drive (12).

Also arranged on the rotary platform (15) of the mobile shaft winch (10) is a hydraulic system (27) which is designed for an operation of the auxiliary functions of the mobile shaft winch (10). The functions are especially for the raising and telescoping of the telescopic jib (18) and also for the rotating of the rotary platform (15). As actuators for these auxiliary functions use is made of hydraulic motors and hydraulic cylinders which by a hydraulic pump (28) are pressurized with a hydraulic fluid from a hydraulic tank (30). The hydraulic pump (28) is driven by an electric motor (29) which during standard operation is supplied with power from the mains supply system (24). In the event of non-availability of the mains supply system (24), the existing generator (25) undertakes the power supply.

As a result of the drive concept according to the invention of the mobile shaft winch (10), the hydraulic system (27) for the auxiliary functions can be of a considerably smaller, simpler and lighter construction. The additional diesel engine which is required in the prior art is dispensed with as a redundant drive for the hydraulic system since the diesel engine (12*a*) of the automotive truck, which is available anyway, is used effectively via the power take-off (26) both for creating the drive energy for the winch drive (22) and for operating the auxiliary units.

List of designations

| No. | Designation |
|---|---|
| 1 | Winch drive |
| 1a | Hydraulic motor |
| 1b | Transmission |
| 2 | Winch |
| 3 | Tank |
| 4 | Pump |
| 4a | Diesel engine |
| 5 | Pump |
| 5a | Electric motor |
| 6 | Hydraulic control system |
| 7 | Mains supply system |
| 10 | Mobile shaft winch |
| 11 | Carrier vehicle |
| 12 | Vehicle drive |
| 12a | Diesel engine of automotive truck |
| 13 | Base frame |
| 14 | Rotary connection |
| 15 | Rotary platform |
| 16 | Drum winch |
| 17 | Haulage rope |
| 18 | Telescopic jib |
| 19 | Deflection roller |
| 20 | Control cabin |
| 21 | Rope drum |
| 22 | Winch drive |
| 22a | Electric motor |
| 22b | Transmission |
| 23 | Control system |
| 24 | Mains supply system |
| 25 | Generator |
| 26 | Power take-off |

-continued

| List of designations | |
|---|---|
| No. | Designation |
| 27 | Hydraulic system |
| 28 | Hydraulic pump |
| 29 | Electric motor |
| 30 | Tank |

The invention claimed is:

1. A mobile shaft winch, comprising:

a carrier vehicle having a vehicle drive, a rigid base frame, and a rotary platform arranged on the base frame via a rotary connection, the vehicle drive having an internal combustion engine;

a drum winch arranged on the rotary platform and including a rope drum driven solely by an electric motor of a winch drive and configured to wind on and unwind a haulage rope, wherein a cage is attached to the haulage rope, the electric motor is a servo motor, and the rope drum, the electric motor, and the haulage rope of the drum winch are configured to transport the cage in a shaft;

an electric generator driven by the internal combustion engine of the vehicle drive via a power take-off constructed as an engageable shaft on an auxiliary output of the vehicle drive, wherein the generator and the internal combustion engine are arranged on the carrier vehicle; and a control system controlling the winch drive, the control system configured to selectively operate the electric motor on a mains supply system or on the electric generator.

2. The mobile shaft winch of claim 1, further comprising a telescopic jib arranged on the rotary platform and including guide elements for the haulage rope.

3. The mobile shaft winch of claim 1, further comprising guide element arranged at a distance from the mobile shaft winch.

4. The mobile shaft winch of claim 1, wherein the cage attached to the haulage rope is configured to transport people and/or equipment in the shaft.

5. A mobile shaft winch, comprising a carrier vehicle having a vehicle drive, a rigid base frame, and a rotary platform arranged on the base frame via a rotary connection, the vehicle drive having an internal combustion engine;

a drum winch arranged on the rotary platform and including a rope drum driven solely by an electric motor of a winch drive and configured to wind on and unwind a haulage rope;

an electric generator driven by the internal combustion engine of the vehicle drive via a power take-off constructed as an engageable shaft on an auxiliary output of the vehicle drive, wherein the generator and the internal combustion engine are arranged on the carrier vehicle;

a control system controlling the winch drive, the control system configured to selectively operate the electric motor on a mains supply system or on the electric generator; and a hydraulic system arranged on the carrier vehicle and configured to operate an auxiliary function of the mobile shaft winch, the hydraulic system including a tank holding hydraulic fluid and an electrically driven hydraulic pump having a suction side and a pressure side, wherein the suction side is in fluid conducting communication with the tank and the pressure side is in fluid conducting communication with an actuator for the operation of the auxiliary function.

6. The mobile shaft winch of claim 5, wherein the actuator of the hydraulic system includes at least one of a hydraulic cylinder and a hydraulic motor.

7. The mobile shaft winch of claim 5, wherein the electrically driven hydraulic pump is configured for operation on the electric generator.

8. The mobile shaft winch of claim 5, wherein the electrically driven hydraulic pump is configured for selective operation on the mains supply system and on the electric generator.

9. The mobile shaft winch of claim 5, further comprising extendable hydraulic supports, the auxiliary function including extension of the hydraulic supports.

* * * * *